US007007444B2

(12) United States Patent
Miller

(10) Patent No.: US 7,007,444 B2
(45) Date of Patent: Mar. 7, 2006

(54) METHOD OF FABRICATING A STACKABLE PACKAGE FOR DISPLAYING PRODUCTS

(76) Inventor: Alan Miller, 261 El Bravo Way, Palm Beach, FL (US) 33480

( * ) Notice: Subject to any disclaimer, the term of this patent is extended or adjusted under 35 U.S.C. 154(b) by 0 days.

(21) Appl. No.: 11/037,933

(22) Filed: Jan. 18, 2005

(65) Prior Publication Data

US 2005/0120677 A1 Jun. 9, 2005

Related U.S. Application Data

(63) Continuation of application No. PCT/US03/21978, filed on Jul. 15, 2003, which is a continuation of application No. 10/199,825, filed on Jul. 19, 2002, now Pat. No. 6,796,423.

(51) Int. Cl.
*B65B 29/00* (2006.01)

(52) U.S. Cl. ..... 53/400; 53/397; 53/461; 53/476; 53/517; 53/449

(58) Field of Classification Search ..... 53/461, 53/476, 147, 509, 517, 399, 400, 397; 206/454
See application file for complete search history.

(56) References Cited

U.S. PATENT DOCUMENTS

| | | | | |
|---|---|---|---|---|
| 3,575,287 | A | 4/1971 | Graveley | |
| 3,700,096 | A | 10/1972 | Reifers | |
| 4,125,633 | A | 11/1978 | Vander Lugt, Jr. | |
| 4,268,530 | A | 5/1981 | Wyslotsky | |
| 4,496,354 | A | 1/1985 | Steer et al. | |
| 4,548,852 | A * | 10/1985 | Mitchell | 426/111 |
| 4,619,361 | A | 10/1986 | Thomas, Jr. | |
| 4,664,922 | A | 5/1987 | Leon et al. | |
| 4,742,908 | A | 5/1988 | Thomas, Jr. et al. | |
| 5,061,501 | A | 10/1991 | Lowe | |
| 5,180,100 | A | 1/1993 | Shimizu | |
| 5,326,577 | A | 7/1994 | Warnock | |
| 5,660,868 | A | 8/1997 | Yeager | |
| 5,741,535 | A | 4/1998 | Cope et al. | |
| 5,839,572 | A | 11/1998 | Yeager | |
| 5,845,769 | A | 12/1998 | Yeager | |
| 5,871,095 | A | 2/1999 | Warnock et al. | |
| 5,888,565 | A | 3/1999 | Gics | |
| 6,110,512 | A | 8/2000 | Teasdale et al. | |
| 6,234,308 | B1 | 5/2001 | Saffron et al. | |
| 6,269,946 | B1 * | 8/2001 | Colombo | 206/213.1 |
| 6,298,983 | B1 | 10/2001 | Yeager | |
| 6,447,826 | B1 * | 9/2002 | Matthews | 426/126 |
| 6,588,594 | B1 | 7/2003 | Andersen et al. | |

FOREIGN PATENT DOCUMENTS

| | | |
|---|---|---|
| DE | 31 14 508 A1 | 11/1982 |
| FR | 2 796 256 A1 | 1/2001 |

* cited by examiner

*Primary Examiner*—John Sipos
*Assistant Examiner*—Christopher Harmon
(74) *Attorney, Agent, or Firm*—Alston & Bird LLP

(57) ABSTRACT

A compact and stackable package for displaying and protecting food and other consumer products is produced by a method wherein the package can be built around the consumer product utilizing primary components which can be shipped to the assembly location in essentially flat condition to thereby minimize shipping costs. The method includes providing a platform member upon which the consumer product is placed, and then adhering a sleeve member around the periphery of the platform member to impart a cubic form to the package. Also, the consumer product can be covered with a transparent film wrap to secure the product to the platform member.

16 Claims, 4 Drawing Sheets

METHOD OF FABRICATING A STACKABLE PACKAGE FOR DISPLAYING PRODUCTS

CROSS REFERENCE TO RELATED APPLICATION

The present application is a continuation of international application PCT/US03/21978 filed 15 Jul. 2003, and which claims priority from U.S. application Ser. No. 10/199,825, filed Jul. 19, 2002 (now U.S. Pat. No. 6,796,423 B2). The disclosures of the referenced applications are incorporated herein by reference.

FIELD OF THE INVENTION

The present invention relates to packaging and more particularly to a compact and stackable package for displaying consumer products such as food products.

BACKGROUND OF THE INVENTION

Most fresh meat, fish and poultry products sold at retail are packaged in trays formed of wood fibers, paperboard, plastic foam or thermoform plastic sheet material. An absorbent pad is frequently placed in the tray to absorb fluids which exude from the product. The tray and product is then overwrapped with a transparent plastic film. Examples of such packages are disclosed in U.S. Pat. Nos. 3,575,287; 3,700,096 and 4,664,922.

Sometimes, the product is placed in a plastic bag and sealed. Examples of this type of package are disclosed in U.S. Pat. Nos. 4,619,361; 4,742,908; and 5,660,868.

Prepared meats, etc., are packaged in a variety of blister-packs, specialty packs and the like. Examples of this type of packaging are disclosed in U.S. Pat. Nos. 4,125,633; 4,268,530; 4,496,354; 5,061,501; 5,326,577; 5,871,095; 5,888,565 and 6,110,512.

Sellers prefer to offer attractive packages which display the products and have informative and eye-catching indicia and graphics that attract and convince customers and consumers to purchase the products. Sellers also prefer packaging which permits them to brand their products and differentiate their products from competitors products.

Consumers prefer neat, clean and attractive packages which contain informative indicia and graphics. Most of all, however, purchasers want to see the products they are buying to the maximum extent possible.

Heretofore, trays and other packaging materials, except for the overwrap film, have not been transparent and therefore cover and obscure the consumer's view of the product. Attempts have been made to provide transparent windows, but such typically expose only a minor amount of the product. Even where transparent film would otherwise have exposed a significant amount of the product, printed indicia, labels and the like have prevented an uninterrupted view of the products.

Another major disadvantage of prior packaging is that such packaging has almost universally been of irregular size and shape. Both producers and consumers prefer packages of uniform shape and size which are much easier to pack and inventory. Most, if not all, of the packages heretofore in use have been of irregular shape and size, and therefore have been difficult to stack and display. Indeed, the shapes of such prior packaging have dictated that such packages be displayed in horizontal display cases. These refrigerated cases are inefficient, costly and are difficult for consumers to access.

Such prior packaging frequently will leak exudates into the display cases creating an unsightly mess and necessitating frequent cleaning or onto consumers hands or into carrying bags or containers. Such propensity is decidedly disadvantageous and causes consumer dissatisfaction.

With the foregoing in mind, it is an object of the present invention to provide a package for displaying products that is neat, clean, attractive, regular in size and shape, provides good visibility of the product, permits branding and product differentiation, and therefore obviates the deficiencies and disadvantages of the prior packaging.

It is a further object of the invention to provide a method of fabricating a package wherein the components of the package can be shipped to the assembly location at minimal cost.

BRIEF SUMMARY OF THE INVENTION

These and other objects and advantages of the invention are achieved by the provision of a method of fabricating a stackable package which includes the steps of providing a platform member having a substantially planar portion of generally rectangular outline on which the consumer product may be placed and supported, and then adhering a sleeve member around at least a substantial portion of the periphery of the platform member to impart a cubic form to the package. A transparent film wrap may be positioned to cover the consumer product and secure the product to the platform member.

The platform member preferably includes a base portion extending along one side edge of the planar portion and which extends laterally outwardly therefrom so as to be adapted to support the consumer product thereon. Also, the base portion permits the platform member to be supported on a horizontal surface with the planar portion disposed in a substantially vertical orientation. The base portion may be integral with the planar portion or removably attached thereto. The base portion may also include a well or cavity therein, in which an absorbent material may be placed to absorb exudants from the product. This well may also contain anti-microbial agents and/or carbon dioxide generators/oxygen removing agents.

The sleeve member encircles the platform member and the product to ensure the package has a regular cubic shape and to provide surfaces for printed indicia and advertising, marketing, or informational printing thereon. Preferably, the sleeve is formed of an elongate paperboard or plastic member having a width substantially equal to the width of the base portion of the platform member and at least as great as the thickness or height of the product such that the weight of superposed packages will be borne by the sleeve member and not the product. The sleeve member may be provided with a tear strip to aid in the removal thereof when the product is to be removed from the package.

The transparent plastic film wrap, which may be a stretch or shrink film, is wrapped around the platform member and product to unitize the same. If desired, the sleeve member may be applied before the film wrap, but it is preferred that the sleeve member encircles the platform member, product and film wrap. The film wrap should be adhered or heat-sealed at least to the front and sides of the base portion and to the perimeter of the platform member, but should not obstruct the visibility of the product.

Preferably, the platform, product, film wrap and sleeve member may be over-wrapped in plastic film, shrink wrap or lidded by plastic film. This overwrap provides a second barrier to the escape of exudates from the package and renders the package more leak-proof.

BRIEF DESCRIPTION OF THE DRAWINGS

Figure 1:
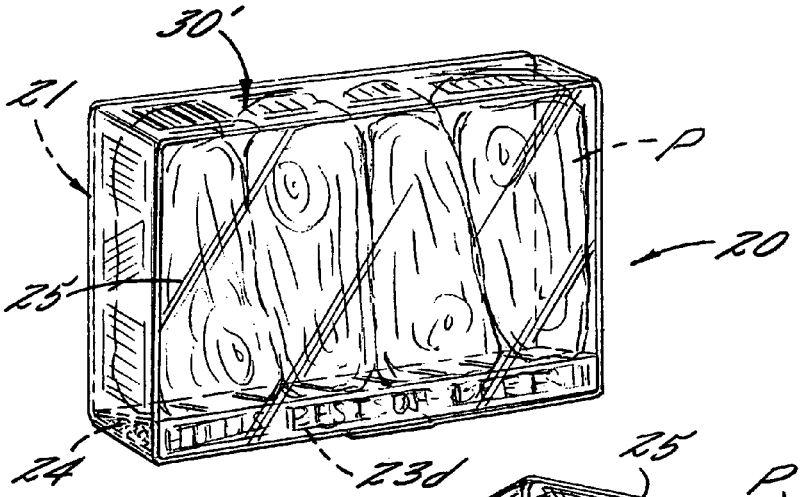
Figure 2:
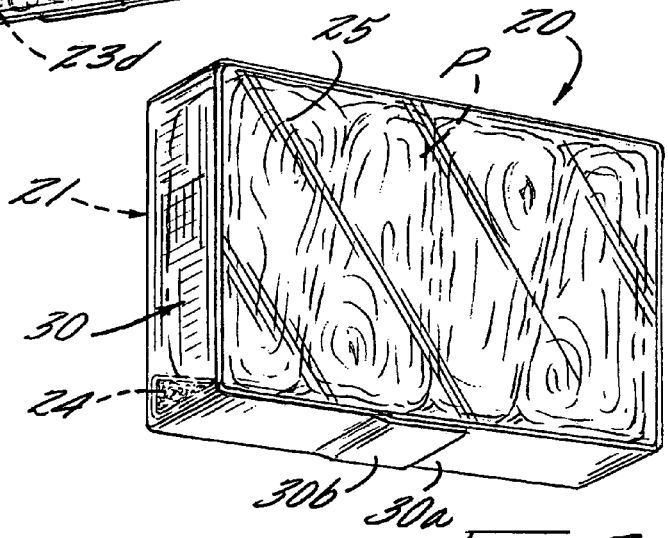
Figure 3:
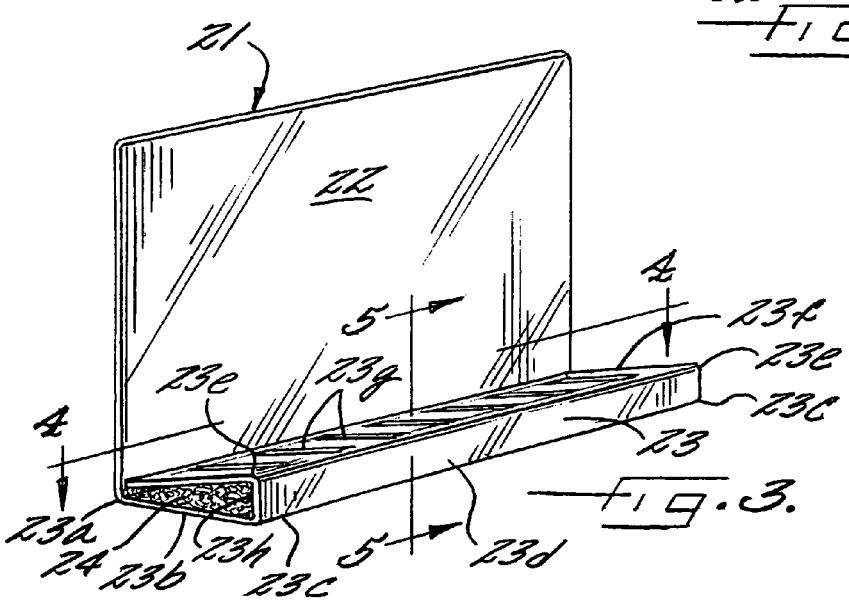
Figure 4:
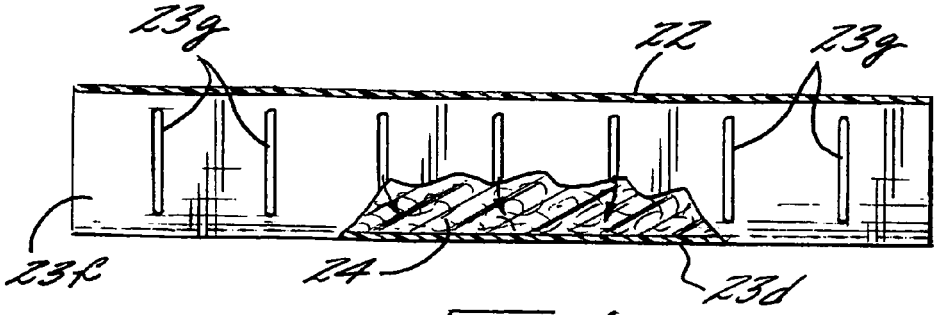
Figure 5:
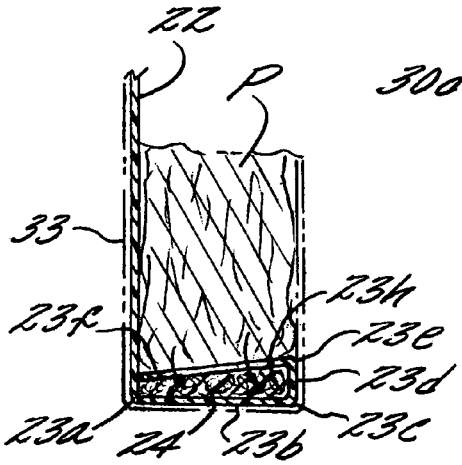
Figure 6:
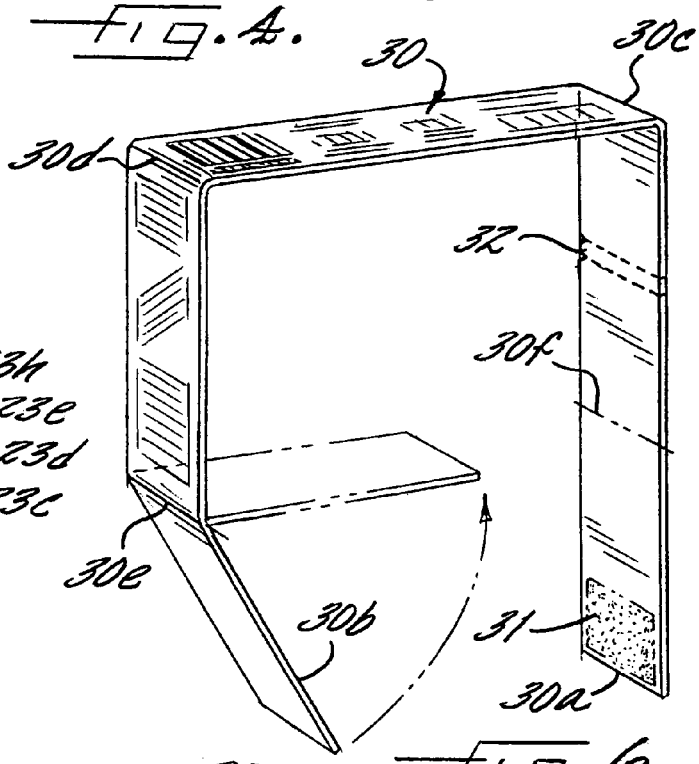
Figure 7:
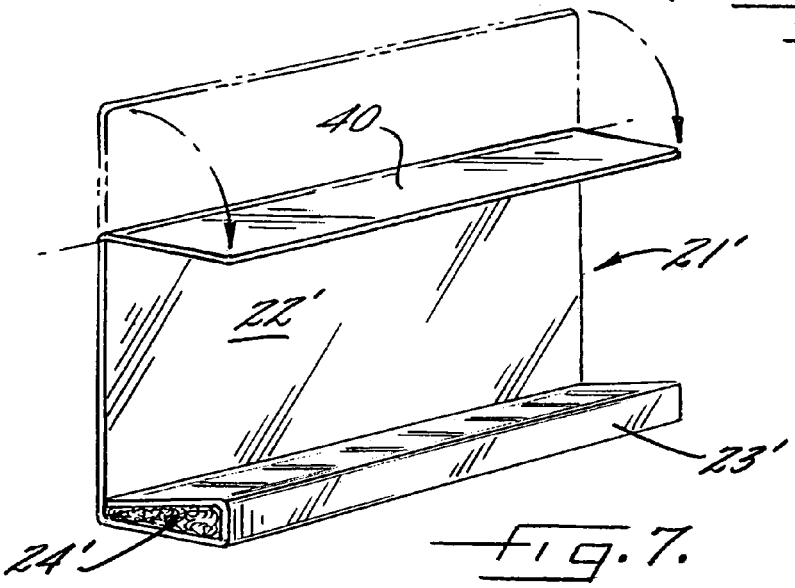
Figure 8:
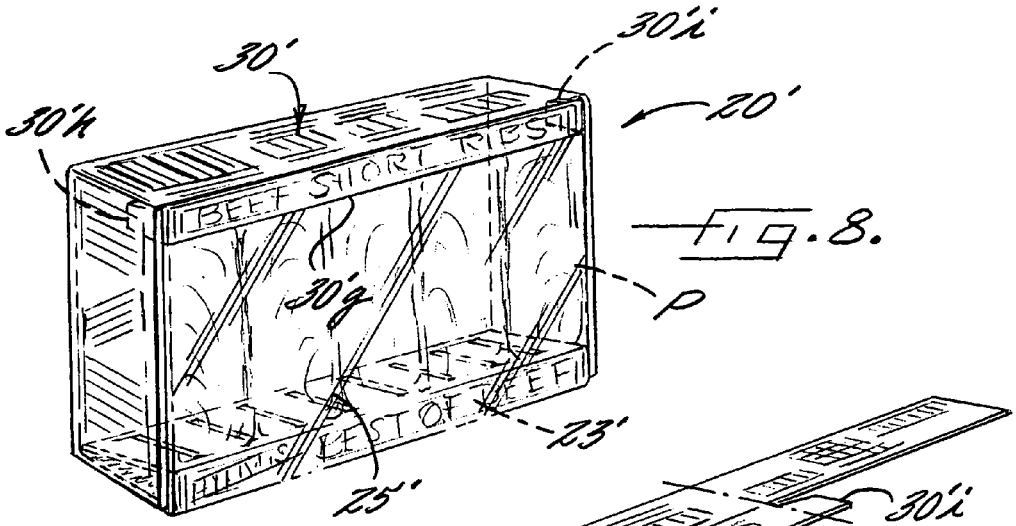
Figure 9:
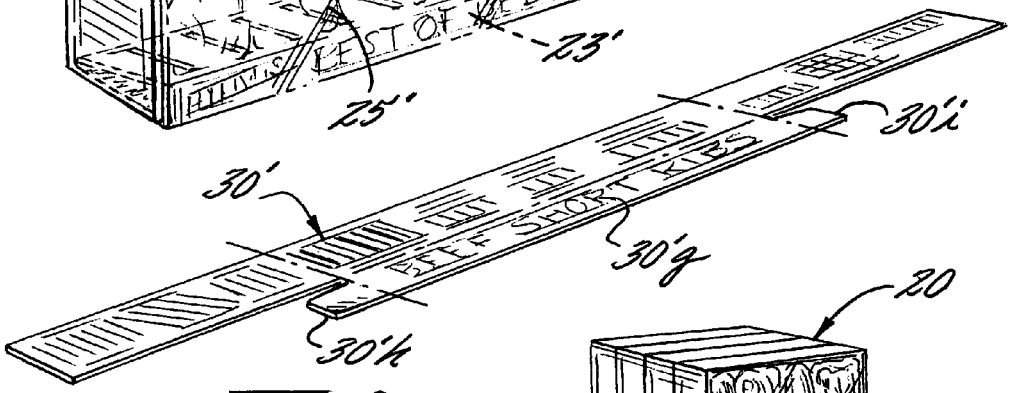
Figure 10:
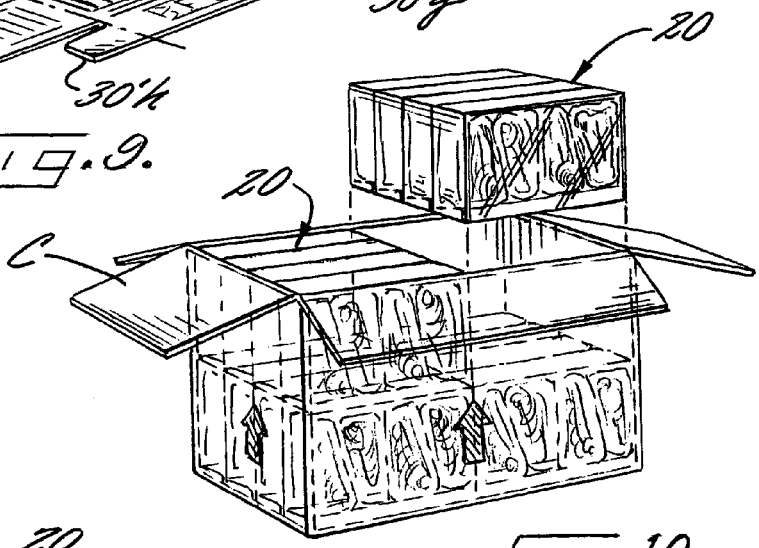
Figure 11:
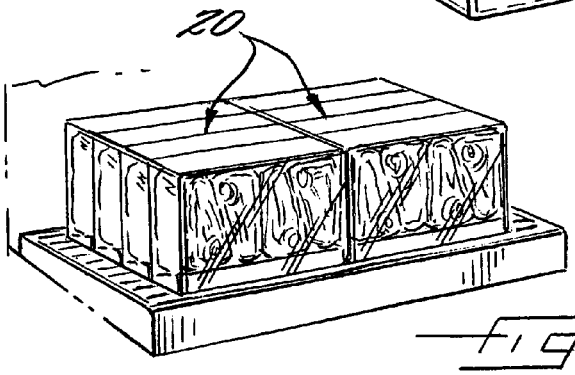
Figure 12:
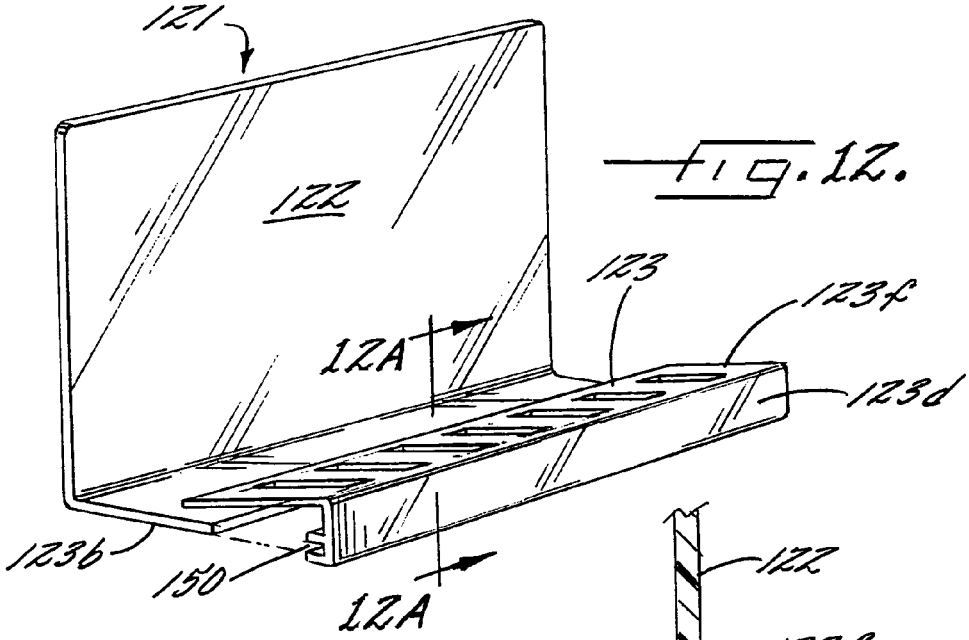
Figure 12A:
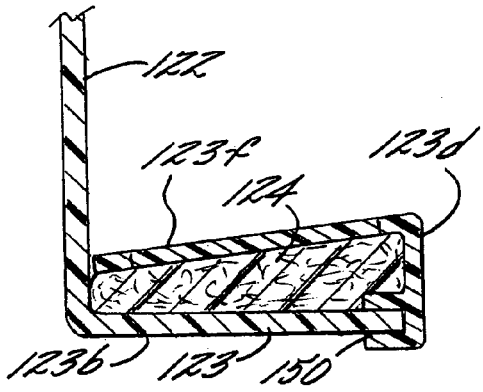
Figure 13:
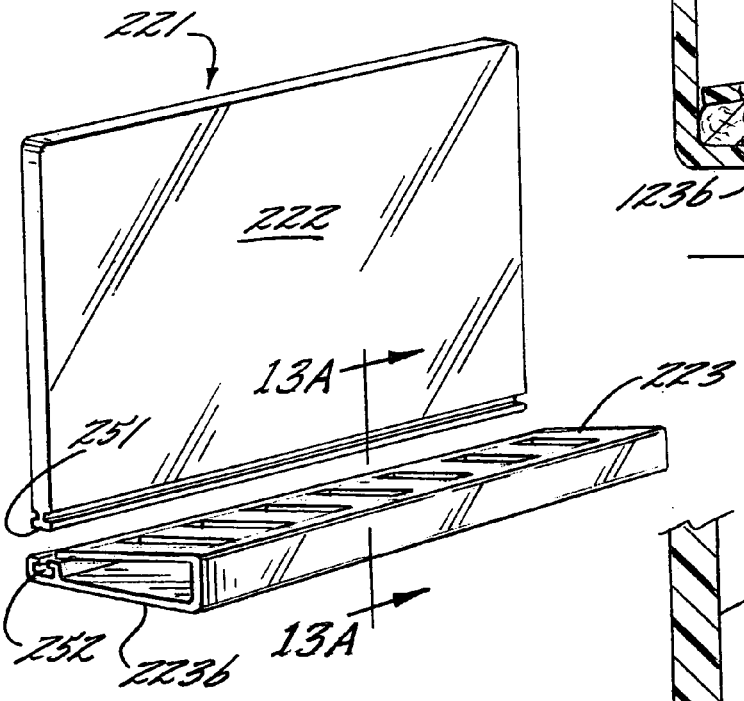
Figure 13A:
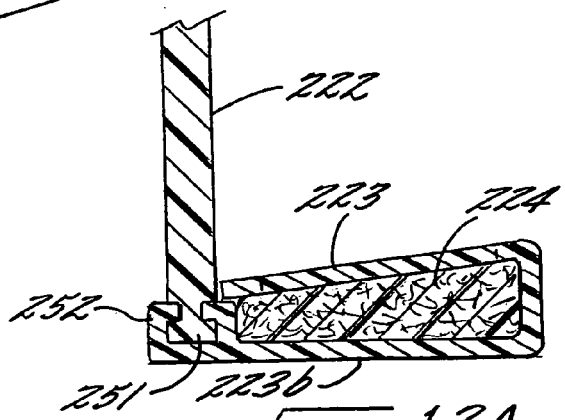

Having thus described the invention in general terms, reference will now be made to the accompanying drawings, which are not necessarily drawn to scale, and wherein:

FIG. 1 is a frontal perspective view of a package according to the present invention;

FIG. 2 is a view similar to FIG. 1, but showing the bottom of the package of FIG. 1;

FIG. 3 is a frontal perspective view of the platform member of the package of the present invention;

FIG. 4 is a sectional view taken substantially along line 4—4 in FIG. 3;

FIG. 5 is a fragmentary sectional view taken substantially along line 5—5 in FIG. 3;

FIG. 6 is a perspective view of the sleeve member of the package of FIG. 1 illustrating the folding thereof;

FIG. 7 is a perspective view similar to FIG. 3 of another embodiment of the platform member of the package of the present invention;

FIG. 8 is a view similar to FIG. 1 of another embodiment of the package of the present invention;

FIG. 9 is a perspective view of the sleeve member shown in FIG. 8;

FIG. 10 is a perspective view of a carton being packed with packages of the present invention;

FIG. 11 is a perspective view of a typical display case containing the packages of the present invention;

FIG. 12 is a perspective view similar to FIG. 3 of a further embodiment of the platform member of the present invention;

FIG. 12A is a fragmentary sectional view taken substantially along line 12A—12A in FIG. 12;

FIG. 13 is a perspective view similar to FIGS. 3 and 12 of a still further embodiment of the platform member of the present invention; and FIG. 13A is a fragmentary sectional view taken substantially along line 13A—13A in FIG. 13.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now more particularly to the drawings, there is illustrated a package, generally indicated at 20, incorporating the features of the present invention (FIGS. 1 and 2). Package 20 includes a platform member, generally indicated at 21 (FIG. 3), which is formed of a sheet of transparent thermoplastic material having sufficient rigidity and structural integrity to resist bending and to support and protect the product P during packing, shipment, storage and handling.

Platform member 21 includes a generally rectangular planar portion 22 which defines substantially parallel upper and lower edges, and opposite side edges. Also, a base portion 23 is included, which is preferably formed by thermoforming, i.e., heating, bending and cooling, the sheet of thermoplastic material along a first fold line 23*a* to provide a bottom member 23*b* extending outwardly at substantially a right angle to planar portion 22. Next, the thermoplastic sheet is bent along a second fold line 23*c* to provide an outer member 23*d* extending upwardly, substantially parallel to planar portion 22, and then is bent along a third fold line 23*e* to provide an upper support member 23*f* extending toward planar portion 22 from the outer member 23*d*. Preferably, the upper support member 23*f* extends toward planar portion 22 at a small declining angle. Members 23*b* and 23*f* preferably have a width which extends between planar portion 22 and outer member 23*d* at least as great as the thickness of the product P so that the product P will not extend outwardly beyond the outer member 23*d*.

The upper support member 23*f* preferably has perforations or slots 23*g* formed therethrough so that liquids exuding from the product P may pass therethrough and collect in the space or well 23*h* between bottom member 23*b* and upper support member 23*f*. The well 23*h* extends the full length of the planar portion 22 and the length thereof is determined by the cubic volume needed to contain the exudants and other liquids normally encountered with each particular product being packaged.

Preferably, an absorbent material 24 is contained within well 23*h* to absorb any exudants or other liquids draining into well 23*h*. The absorbent material 24 may be plant fibers, desiccants, super-absorbents, etc., which are well known to persons skilled in the packaging arts. Additionally, antimicrobial agents, deodorants or oxygen scavengers with or without accompanying carbon dioxide generators may be included in well 23*h*.

The product P, such as, for example, beef steaks, are placed on platform member 21 with one major surface against planar portion 22 and one edge resting on the upper support member 23*f* which functions as a shelf on which the product P is supported. A transparent thermoplastic film wrap 25 is then applied to unitize the product P and platform member 21. While the wrap 25 may completely enclose the platform member 21 and the product P, it is preferred that the wrap 25 only extend over the product P and into contact with the periphery of the platform member 21, including the top and ends of the planar portion 22 and the ends and outer member 23*d* of base portion 23, to which the wrap 25 is secured or heat-sealed.

A sleeve member 30 is formed of an elongate strip of paperboard, plastic or other material which is readily printable and which has sufficient rigidity to support other packages stacked thereon (FIG. 6). Sleeve member 30 has a width at least as great as the width of base portion 23 of platform member 21 and a length slightly greater than the circumference of the package 20 so that opposite end portions 30*a* and 30*b* overlap. An adhesive 31 is provided to secure the opposite end portions 30*a* and 30*b* together. Preferably, sleeve member 30 is provided with a tear strip 32 for ease of removal of sleeve member 30 when the product is to be removed.

Sleeve member 30 has four fold lines 30*c*, 30*d*, 30*e* and 30*f* therein at locations corresponding to the corners of the platform member 21. In use, sleeve member 30 is wrapped around the periphery of the platform member 21, the product P and wrap 25, and it's opposite end portions 30*a* and 30*b* are overlapped and secured together by adhesive 31 (FIG. 2). Sleeve member 30 may have indicia printed thereon, including but not limited to, product description and contents, marketing information, source identification, etc.

Preferably, an additional overwrap 33 (FIG. 5) of plastic film, such as stretch or shrink film, may be used to protect the sleeve member 30 and retain the sleeve member 30 in place, and to form an additional barrier to leakage of exudates from the package 20. Alternatively, sleeve member 30 may be adhered or otherwise attached to the platform member 21 or first wrap 25.

Referring now to FIGS. 7–9, there is illustrated another embodiment of the package of the present invention with like reference characters with the prime notation added referring to like components. In FIG. 8, there is illustrated a package, generally referred to at 20', which includes a platform member, generally referred to at 21'. Platform member 21' is substantially similar to platform member 21, with a planar portion 22' and a base portion 23'. In addition, platform member 21' has a top portion 40 which extends outwardly from planar portion 22' parallel to base portion 23' and for substantially the same distance. Therefore, the product will be enclosed by the platform member 21' on the top, bottom and one side for extra protection.

As with package 21, a unitizing wrap 25' of plastic film is used to enclose the open front and opposite ends of the platform member 21'. The wrap 25' may completely enclose the platform member 21', but preferably wrap 25' is adhered to the periphery of platform member 21' and therefore covers only the open space occupied by the product.

A partial sleeve member 30' extends from one end of base portion 23' upwardly, across top portion 40 and downwardly to the other end of base portion 23'. Preferably, sleeve member 30' is adhered to platform member 21' at least at the opposite ends of base portion 23'. Sleeve member 30' includes a projecting portion 30'g extending outwardly from the medial portion of sleeve member 30'. Projecting portion 30'*g* has tab portions 30'*h* and 30'*i* at its opposite ends. Tab portions 30'*h* and 30'*i* are not connected to the remainder of the sleeve member 30'.

Projecting portion 30'*g* is folded downwardly over the front edge of top portion 40 of platform member 21' in front of the top portion of the product receiving open space. Projecting portion 30'*g* thus provides a convenient and very visible banner for printing indicia to draw attention to the product. The tab portions 30'*h* and 30'*i* are folded rearwardly inside the end portions of sleeve member 30' and to which they may be adhered. A final overwrap 33 of plastic film completes the package 20'.

FIG. 10 illustrates the manner in which packages 20 or 20' may be packed in a carton C while maximizing the use of available space therein and still protecting the product.

FIG. 11 illustrates the display of the products in packages 20 or 20' in an upright or vertical orientation as opposed to the limited horizontal orientation of prior packages.

Referring now to FIGS. 12 and 12A, there is illustrated a further embodiment of the present invention in which like reference characters with the prefix "1" are used to refer to like elements. A platform member, generally referred to as 121, includes a planar portion 122 and a base portion 123. Base portion 123 includes a bottom member 123*b*.

In this embodiment, base portion 123 is bifurcated or formed in two parts with one part being removably connected to bottom member 123*b*. An outer member 123*d* has a female receptacle connector portion 150 which receives the outer free end portion of the bottom member 123*b* therein to connect removably the two segments together. An upper support member 123*f* completes the base portion 123.

Referring now to FIGS. 13 and 13A, there is illustrated a still further embodiment of the present invention in which like reference characters with the prefix "2" added are used to refer to like elements. A platform member, generally indicated at 221, includes a planar portion 222, which terminates at its bottom edge in a male connector portion 251, and a base portion 223. Base portion 223 includes a bottom member 223*b* which includes at its inner edge a female connector portion 252. Male connector portion 251 is received in female connector portion 252 to connect removably the two segments together.

Base portions 123 and 223 are adapted to receive and contain absorbent material 124 and 224, respectively, for absorbing and containing exudates and other liquids. While not specifically illustrated, it should be understood that platform members 121 and 221 will receive products thereon and will be used with the other elements of the package of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of fabricating a stackable package containing a consumer product, comprising the steps of providing a platform member which includes a substantially planar portion of generally rectangular outline on which the consumer product may be placed and supported, and a base portion secured along one side edge of the planar portion and extending laterally outwardly therefrom so as to be adapted to support the consumer product thereon and to support the platform member on a horizontal surface with the planar portion disposed in a substantially vertical orientation, placing a consumer product on the platform member, adhering an elongate strip of material completely about the periphery of the platform member with the ends of the strip overlapping each other below the base portion of the platform member, and so that the strip of material forms a sleeve member which extends substantially perpendicular to the planar portion of the platform member and imparts a cubic form to the package, and covering the consumer product with a transparent film wrap which is secured to the platform member and/or the sleeve member.

2. The method of claim 1 wherein the transparent film wrap is secured to the platform member prior to the sleeve member being adhered thereto so that the sleeve member overlies the transparent film wrap.

3. The method of claim 2 comprising the further subsequent step of securing a transparent film overwrap to the platform member so as to overlie the transparent film wrap and the sleeve member.

4. The method of claim 1 wherein the transparent film wrap is secured to the sleeve member after the sleeve member is adhered to the platform member so that the transparent film wrap overlies the sleeve member.

5. The method of claim 1 wherein the base portion of the platform member includes a well or cavity, with an absorbent material in said well or cavity.

6. The method of claim 5 wherein said base portion further includes a bottom member extending outwardly from said planar portion, an outer member connected to said bottom member and extending substantially parallel to said planar portion, and an upper member connected to said outer member and extending toward said planar portion in spaced relation, to said bottom member to define said well or cavity therebetween.

7. The method of claim 6 wherein said upper member is perforated to permit exudants to pass through said upper member into said well or cavity.

8. The method of claim 6 wherein the platform member is formed of a sheet of thermoplastic material which is sequentially bent to form the bottom member, the outer member, and the upper member of the base portion.

9. The method of claim 1 wherein the planar portion of the platform member is formed of the sheet of transparent thermoplastic material.

10. A method of fabricating a stackable package containing a consumer product, comprising the steps of providing a platform member which comprises a substantially planar portion of generally rectangular outline on which the consumer product may be placed and supported, a base portion secured along one side edge of the planar portion and extending laterally outwardly therefrom so as to be adapted to support the consumer product thereon and to support the platform member on a horizontal surface with the planar portion disposed in a substantially vertical orientation, placing a consumer product on the platform member, covering the consumer product with a transparent film wrap which is secured to the platform member so as to secure the consumer product on the platform member, then adhering an elongate strip of material around at least a significant portion of the periphery of the platform member and so that the strip of material forms a sleeve member which extends substantially perpendicular to the planar portion of the platform member and so that the base portion of the platform member and the sleeve member impart a cubic form to the packages and then securing a transparent film over wrap to the platform member so as to overlie the transparent wrap and the sleeve member.

11. The method of claim 10 wherein the base portion of the platform member includes a well or cavity, with an absorbent material in said well or cavity.

12. The method of claim 11 wherein said base portion includes a bottom member extending outwardly from said planar portion, an outer member connected to said bottom member and extending substantially parallel to said planar portion, and an upper member connected to said outer member and extending toward said planar portion in spaced relation to said bottom member to define said well or cavity therebetween.

13. The method of claim 12 wherein said upper member is perforated to permit exudants to pass through said upper member into said well or cavity.

14. The method of claim 10 wherein the adhering step comprises wrapping the strip of material completely about the periphery of the platform member with the ends of the strip overlapping each other below the base portion of the platform member.

15. The method of claim 10 wherein the base portion of the platform member defines a width dimension which is perpendicular to the planar portion, and wherein the sleeve member has a width which generally equals the width dimension of the base portion when the sleeve member is adhered to the periphery of the platform member.

16. The method of claim 10 wherein the consumer product is a food product.

* * * * *